US005186710A

United States Patent [19]

Koch et al.

[11] Patent Number: 5,186,710

[45] Date of Patent: Feb. 16, 1993

[54] TRANSPORT INCUBATOR HAVING AN INTEGRATED ENERGY STORE

[75] Inventors: Jochim Koch, Ratzeburg; Ulrich Heim, Lübeck, both of Fed. Rep. of Germany

[73] Assignee: Drägerwerk Aktiengesellschaft, Lübeck, Fed. Rep. of Germany

[21] Appl. No.: 718,958

[22] Filed: Jun. 21, 1991

[30] Foreign Application Priority Data

Jul. 14, 1990 [DE] Fed. Rep. of Germany ..... 4022448

[51] Int. Cl.[5] ..... A61G 11/00

[52] U.S. Cl. ..... 600/22

[58] Field of Search ..... 600/21-22; 128/736

[56] References Cited

U.S. PATENT DOCUMENTS 3,918,432 11/1975 Franz et al. ..... 600/22
3,919,999 11/1975 Gluck et al. ..... 600/22
4,458,674 7/1984 Lemburg et al. ..... 600/22

FOREIGN PATENT DOCUMENTS 3425419 1/1986 Fed. Rep. of Germany .
3533271 3/1987 Fed. Rep. of Germany ..... 600/22
2203946 11/1988 United Kingdom .

*Primary Examiner*—Lee S. Cohen
*Assistant Examiner*—John P. Lacyk
*Attorney, Agent, or Firm*—Walter Ottesen

[57] ABSTRACT

The invention is directed to a transport incubator for accommodating prematures and newborns in a compartment wherein the temperature is controlled by means of an energy store which is in thermal contact with the compartment. The transport incubator is improved in that the energy store is made as small and as light as possible and does not have to be supplied with energy continuously in the operating condition. In addition, the transport incubator can be produced at low cost while utilizing environmentally friendly materials. The energy store is configured as an adsorption vessel containing an adsorption material. For generating the heat to be supplied to the infant compartment, the adsorption vessel can be connected to a supply vessel which contains a fluid which is adsorbing on the adsorbing vessel while giving off adsorption heat.

6 Claims, 2 Drawing Sheets

TRANSPORT INCUBATOR HAVING AN INTEGRATED ENERGY STORE

FIELD OF THE INVENTION

The invention relates to a transport incubator for accommodating prematures and newborns and includes an energy store integrated therein. Transport incubators require an energy store for maintaining the temperature of the interior thereof during transport.

BACKGROUND OF THE INVENTION

Published British patent application 2,203,946 discloses a transport incubator wherein the energy is stored in a latent heat store containing molten wax. The heat released as the wax becomes rigid brings liquid from low-boiling fluorinated hydrocarbons to boiling which, in turn, releases the heat to the air in the incubator interior in a heat exchanger mounted in the incubator interior space.

Disadvantages associated with this known incubator are: the high weight and large constructive volume of the latent heat store and the heat exchanger as well as the necessity of using environmentally unfriendly fluorinated hydrocarbons. Furthermore, it is a disadvantage that the latent heat store must be continuously heated if it is to be available for use on demand and requires a complex heat insulation.

SUMMARY OF THE INVENTION

It is an object of the invention to provide a transport incubator having an integrated energy store wherein the energy store is as small and as light as possible as well as not requiring a continuous energy supply during the operational ready condition thereof. It is another object of the invention to provide such an incubator which can be produced at low cost while utilizing environmentally friendly materials.

The transport incubator of the invention has an infant compartment for accommodating an infant and includes: a base; an incubator hood seated on the base to define the infant compartment for accommodating the infant; an energy store mounted in the incubator; the energy store including a holding vessel and adsorption means disposed in the holding vessel; a supply vessel for a fluid which is adsorbable by the adsorption means; and, connecting means for connecting the vessels so as to permit the fluid to flow into the holding vessel where the fluid is adsorbed by the adsorption means thereby releasing heat for heating the compartment.

Materials having a large inner surface such as activated charcoal, silica gel and zeolite can adsorb gases such as water vapor, nitrogen, oxygen, carbon dioxide and low-boiling hydrocarbons in large amounts. The condensation heat and adsorption heat released as a consequence of this adsorption leads to an intense warming of the adsorption means.

Published German patent application 3,425,419 discloses an apparatus operating pursuant to this principle. Zeolite is disposed in a first evacuated vessel. This adsorption means vessel is connected via a valve to a supply vessel wherein water and water vapor are disposed in thermodynamic balance. When the valve is opened, the water vapor flows from the supply vessel into the adsorption means vessel and is there adsorbed on the zeolite while giving up energy (adsorption heat and condensation heat). Additional water then vaporizes in the supply vessel whereby the remaining water cools down. The water vapor is, in turn, adsorbed by the zeolite until the zeolite is saturated with water. The adsorbed water can be again desorbed from the saturated zeolite by heating the adsorption means vessel. The water vapor produced in this manner is then brought in the supply vessel to condensation by its cooling and the valve is closed. In this way, the apparatus is regenerated for a new use.

A transport incubator equipped with an adsorption heat store of this kind defines a very advantageous embodiment. The materials zeolite and water are very friendly to the environment since they are non-toxic. Because of the high adsorption coefficient of zeolite for water, an energy amount of approximately 110 Wh per kg of apparatus mass can be stored (for a latent heat store, this value is only approximately 36 Wh/kg). In this way, an energy store of this kind can be built smaller and of less weight than a latent heat store. Furthermore, such an apparatus can be very inexpensively produced since the materials zeolite and water are inexpensive. Energy stores which operate pursuant to the adsorption principle furthermore require no supply of energy during the time that they are operationally ready. The stored energy amount is adequate for a long service use because of the possibility of providing a controlled heat release.

The adsorption means can be regenerated by means of a heating device operated for example electrically and being in thermal contact with the adsorption means vessel. Furthermore, the heating device can operate to maintain the temperature of the transport incubator in stationary operation. The thermal contact can be produced via radiation and convection when the adsorption means vessel and the heating device are mounted so as to be close to each other but without direct touching contact. Thermal contact is produced via heat conductivity when the adsorption means vessel and the heating device are connected by a good heat-conductive material such as copper. A further possibility is that the heating device can be mounted in the interior of the adsorption means vessel. In this way, the best possible thermal contact to the adsorption material during the regeneration is ensured.

The adsorption means vessel and the heating device can be mounted in a convection shaft which is in flow communication with the part of the transport incubator wherein the temperature is to be maintained. With this configuration, a circulation of the air utilizing the natural convection of the heated air takes place without the need of a ventilator.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
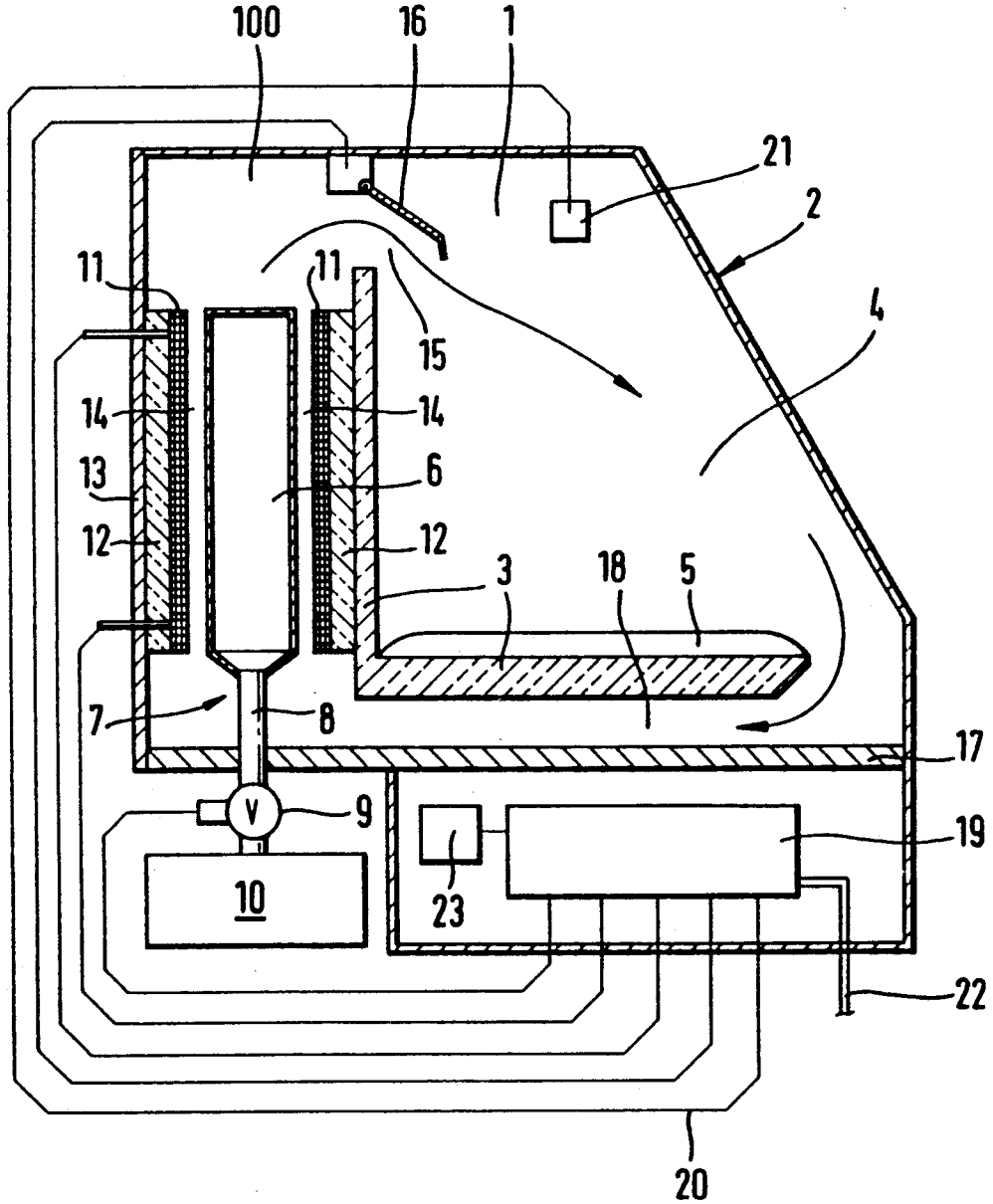
FIG. 1 is a schematic side elevation view, partially in section, of a transport incubator according to the invention.

The interior 1 of the transport incubator 2 is subdivided by a thermally insulating angled partition wall 3.

In the front part 4, a cot 5 for an infant is disposed on the horizontal leg of the partition wall 3. A rearward part 100 of the interior is disposed behind the vertical leg of the partition wall 3 wherein an adsorption means vessel 6 of an adsorbing heat store 7 is mounted. The adsorbing means vessel 6 is connected via a line 8 and a valve 9 to a water vessel 10 mounted outside of the incubator 1. Two electrical heating elements 11 are mounted forward of and rearward of the adsorption means vessel 6 and are in thermal contact therewith. The heating elements 11 are thermally insulated from the rear wall 13 and the partition wall 3, respectively, by respective insulating layers 12. The two gaps between the heating elements 11 and the adsorption means vessel 6 define a convection shaft 14 through which the heated air rises by convection.

The front part 4 of the incubator interior 1 is connected to the rear part 100 via a gap 15 which is arranged in the region above the vertical portion of the partition wall 3 and can be closed more or less via an electrically adjustable flap 16.

An air channel 18 is provided between the horizontal portion of the partition wall 3 and the base 17 of the incubator. An electronic control 19 is mounted below the base 17 and is connected via lines 20 with the following: the valve 9, the electric heating elements 11, the flap 16 and a temperature sensor 21. The transport incubator is supplied with electrical energy via a supply line 22 from the house current supply for heating during stationary operation for the care of a patient. For preparing for transport, it is advantageous to maintain the incubator interior warm with the aid of the heating elements 11 in order to conserve the energy from the heat store 7 for use during transport.

In the operational ready condition of the transport incubator, the adsorption store 7 is charged, that is, the zeolite is free of water and it is not necessary to supply energy in order to maintain the energy supply in the adsorption store 7. In the front part 4 of the interior 1, a specific desired temperature is maintained by the electronic control 19 with the aid of the electric heating elements 11 and by driving the flap 16. The actual temperature is determined with the temperature sensor 21. The air heated by the electrical heating elements rises and then flows through a gap 15 into the front part 14 of the interior and then flows via the air channel 18 back again to the electrical heating elements 11. The gap 15 is opened more or less by the flap 16.

When the transport incubator is placed into service for transporting an infant, the supply line 22 is separated from the house current supply. A built-in battery 23 now supplies the electronic control 19 with electrical energy and the electrical heater is switched off. If heat energy is now required, then the electronic control 19 opens the valve 9 of the adsorption store 7. Water vapor then flows from the water vessel 10 into the adsorption means vessel 6 and is here adsorbed while developing heat. If the adsorption means vessel 6 is still warmed by a previous heating by the electrical heating elements 11, then this residual heat is first used before a significant adsorption starts. This effect increases the time that the adsorption store 7 can be used.

The adsorption means vessel 6 is provided with ribs (not shown) for increasing its surface. The air passing over via convection is warmed and flows through the gap 15 into the forward part 4 of the incubator interior and maintains the temperature of the latter. The flap 16 opens the gap 15 to a lesser or greater extent as required. The air is returned again via the air channel 18.

The valve 9 is actuated for coarsely controlling the heating power by the electronic control 19 thereby controlling the passage of water vapor from the water vessel 10 into the adsorption means vessel 6. The control of the valve 9 can take place in an analog manner or a clocked manner. Since the adsorption means vessel 6 has a relatively large thermal inertia, a more rapid fine control of the heating power by driving the flap 16 is provided in addition to the coarse control. The flap 16 varies the size of the gap 15 through which the heated air passes into the forward part 4 of the incubator interior.

The water vessel 10 of the adsorption store 7 cools down during operation. The water vessel 10 is therefore mounted outside of the incubator interior 1 and is provided with ribs (not shown), so that this vessel can take heat from the surrounding air. In this way, the cool-down effect is reduced and the adsorption store operates with greater effectiveness.

The adsorption vessel 7 is exhausted when the zeolite in the adsorption means vessel 6 is saturated with water. With this condition, the adsorption store 7 must be regenerated for a new operational use. For this purpose, the valve 9 is opened and the electrical heating elements 11 are driven to their full heating capacity. The flap 16 is closed to prevent overheating of the front part 4 of the incubator interior. The zeolite vessel 6 is heated to such an extent by the electric heating elements 11 that the water is desorbed. It then reaches the water vessel 10 as water vapor and condenses there.

All water can be desorbed from the zeolite by, for example, operating the heater over a predetermined time. If all of the water is desorbed from the zeolite, then the valve 9 is closed and the adsorption store is prepared for a new operational use.

Figure 2:
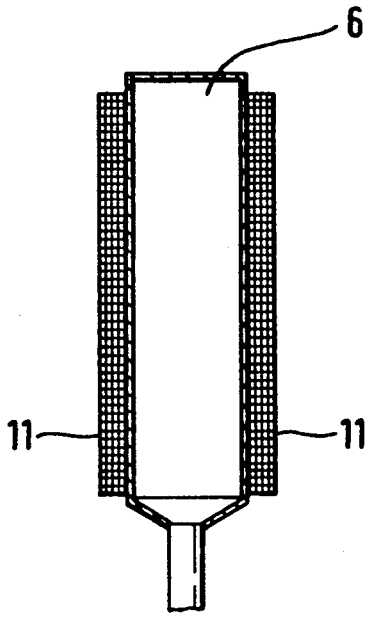
FIG. 2 is a side elevation view of an arrangement of the adsorption means vessel and the electric heater; and, FIG. 3 is another embodiment of the adsorption means vessel with the heating device being disposed therein.

FIG. 2 shows an alternate embodiment of the adsorption means vessel 6 with the heating device 11. In contrast to the embodiment of FIG. 1, a direct metal contact is here provided between the adsorption means vessel 6 and the heating device 11. The heat is therefore transmitted by heat conductivity from the heating device 11 to the adsorption means vessel 6 which is advantageous for the regeneration of the adsorption means.

Figure 3:
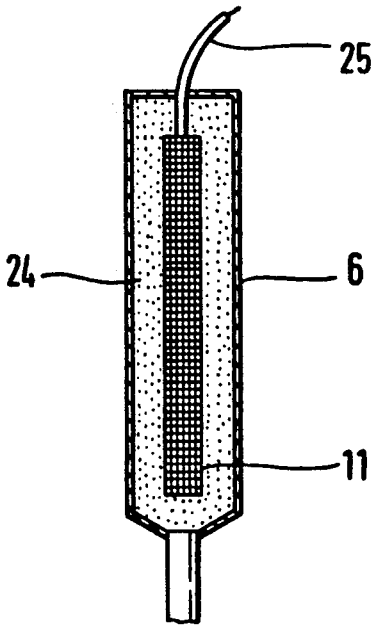

Still another embodiment is shown in FIG. 3 wherein the heat from the heating device 11 is transmitted to the adsorption means. Here, the heating device 11 is mounted in the interior of the adsorption means vessel 6 and is surrounded on all sides by the adsorption means 24. The electrical connecting line 25 of the heating device 11 is passed out through the wall of the adsorption means vessel.

It is understood that the foregoing description is that of the preferred embodiments of the invention and that various changes and modifications may be made thereto without departing from the spirit and scope of the invention as defined in the appended claims.

What is claimed is:

1. A transport incubator having an infant compartment for accommodating an infant, the transport incubator comprising:

a base;

an incubator hood seated on said base to define the infant compartment for accommodating the infant;

an energy store mounted in said incubator;

said energy store including a holding vessel and adsorption means disposed in said holding vessel;

a supply vessel for a fluid which is adsorbable by said adsorption means;

connecting means for connecting said vessels so as to permit said fluid to flow into said holding vessel where said fluid is adsorbed by said adsorption means thereby releasing heat for heating said compartment;

structure means for defining a channel for conducting air toward said infant compartment;

electrical heating means mounted in said channel for imparting heat to the air flowing through said channel;

electrical supply means for supplying electric energy to said heating means from a house current supply so as to permit said heating means to heat the air flowing through said channel during stationary operation of the incubator;

said energy store being mounted in said channel for heating the air flowing through said channel during transport operation of the incubator when the house current supply is unavailable; and, said heating means and said energy store being spaced mutually adjacent so as to place said energy store sufficiently close to said heating means so as to permit said heating means to heat said holding vessel while receiving said electrical energy to desorb and condense said fluid thereby regenerating said energy store and permitting the condensed fluid to flow back to said supply vessel.

2. The transport incubator of claim 1, wherein said adsorption means is zeolite and said fluid is water.

3. The transport incubator of claim 1, further comprising: said heating means and said energy store conjointly defining a convection shaft for conducting the air toward said infant compartment; and, passage means for connecting said convection shaft to said compartment to facilitate the flow of heated air from said convection shaft into said infant compartment for controlling the temperature in said compartment.

4. The transport incubator of claim 3, said structure means including a partition wall for defining a component compartment separated from said infant compartment; said heating means and said energy store being disposed in said component compartment; and, said transport incubator further comprising:

coarse control means for controlling the flow of said fluid between said supply vessel and said holding vessel for coarsely regulating the heat imparted to the air flowing into said infant compartment; and, fine control means for finely controlling the flow of heated air through said passage means into said infant compartment.

5. The transport incubator of claim 4, further comprising: a temperature sensor mounted in said infant compartment; said coarse control means including a conduit interconnecting said vessels; an electrically actuable valve mounted in said conduit for controlling the amount of fluid passing between said vessels; and, a control unit having an input connected to said temperature sensor and a first output connected to said valve for actuating said valve in dependence upon said signal for controlling the amount of heat imparted to said air flowing into said infant compartment;

said fine control means including electrically actuable flap means mounted in said passage means so as to be movable to vary the cross section of said passage means; and, said control unit having a second output connected to said flap means for controlling the amount of heated air flowing through said passage means.

6. The transport incubator of claim 4, said supply vessel being mounted on said transport incubator so as to be exposed to the ambient air.

* * * * *